US006604511B2

(12) United States Patent
Hazama

(10) Patent No.: US 6,604,511 B2
(45) Date of Patent: Aug. 12, 2003

(54) FUEL SUPPLY APPARATUS

(75) Inventor: Tadashi Hazama, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/184,923

(22) Filed: Jul. 1, 2002

(65) Prior Publication Data

US 2003/0002997 A1 Jan. 2, 2003

(30) Foreign Application Priority Data

Jun. 29, 2001 (JP) ..... 2001-198528

(51) Int. Cl.[7] ..... F02M 37/04
(52) U.S. Cl. ..... 123/509; 123/198 D; 137/565.24
(58) Field of Search ..... 123/509, 198 D, 123/510, 514; 137/565.24, 565.17, 565.34, 571, 574, 565.22

(56) References Cited

U.S. PATENT DOCUMENTS 4,780,063 A * 10/1988 Tuckey ..... 417/360
4,869,225 A * 9/1989 Nagata et al. ..... 123/509
5,476,080 A * 12/1995 Brunnhofer ..... 123/468
5,669,359 A * 9/1997 Kleppner et al. ..... 123/509
6,000,913 A * 12/1999 Chung et al. ..... 417/53
6,155,238 A * 12/2000 Briggs et al. ..... 123/509
6,230,690 B1 5/2001 Umetsu
6,382,190 B1 * 5/2002 Tanabe et al. ..... 123/509
6,401,751 B2 * 6/2002 Murakoshi et al. .... 137/565.34

FOREIGN PATENT DOCUMENTS

JP 6-8479 2/1994
JP 10-252592 9/1998

* cited by examiner

*Primary Examiner*—Carl S. Miller
(74) *Attorney, Agent, or Firm*—Nixon & Vanderhye P.C.

(57) ABSTRACT

A fuel supply apparatus in which, even if a column support receiving region of a supporting member is broken, the breakage is prevented from reaching both surfaces of the supporting member. A flange member includes a circular plate-shaped flange body attached to a fuel tank, an inner sleeve into which a column support is inserted, and an outer sleeve located at an outer periphery of the inner sleeve that is integrally formed. A bottom portion of the inner sleeve extends farther on the opposite side of a sub tank than the flange body, and the column support for providing a connection between the sub tank and the flange member has one end press-inserted into the inner sleeve beyond the flange body to a point opposite the sub tank.

20 Claims, 4 Drawing Sheets

FUEL SUPPLY APPARATUS

CROSS REFERENCE TO RELATED APPLICATION

This application is based upon, and claims the benefit of priority of, prior Japanese Patent Application No. 2001-198528 filed on Jun. 29, 2001, the contents of which are incorporated herein by reference.

BACKGROUND OF THE INVENTION

1. Field of the Invention

The present invention relates to a fuel supply apparatus in which a supporting member attached to a fuel tank and a sub tank for housing a fuel pump are coupled to each other by a column support.

2. Description of Related Art

Generally, an example of what is commonly referred to as an in-tank type fuel supply apparatus which is designed to house a fuel pump in a fuel tank consists of a flange member of a fuel supply apparatus, attached to an upper wall of a fuel tank, coupled by a column support made of metal to a pump case for housing a fuel pump. In such a fuel supply apparatus, it is preferable that a part of the flange member that extends toward the pump case be made as small as possible in length. This is especially advantageous in a fuel supply apparatus in which an interval between the flange member and the pump case is reduced in keeping with the use of a lower-profile fuel tank.

Moreover, it is preferable to bring the pump case into contact with the bottom of the fuel tank. By doing so, when the fuel remaining in the fuel tank decreases in volume, the fuel contained in the fuel tank is drawn by the fuel pump through a fuel inlet of the pump case. Also, in a case where a sub tank is used as a pump case, and the fuel within the fuel tank is supplied to the sub tank by a jet pump or the like so the liquid level of the fuel within the sub tank raises to a position above the liquid level of the fuel within the fuel tank, the sub tank should preferably be pressed against the bottom of the fuel tank.

To achieve this, in general, the pump case is coupled to a column support in such a way as to be movable with respect to the supporting member, and a coil spring is disposed around the column support. By increasing an urging force exerted by the coil spring, the pump case presses against the bottom of the fuel tank. In a case where the fuel tank is made of resin, the fuel tank may expand or contract due to a change in its internal pressure. This results in deformation of the fuel tank. Therefore, it is necessary to ensure that the sub tank keeps up with deformation of the fuel tank by pressing the pump case against the bottom of the fuel tank using the urging force of the coil spring. In order to secure the urging force of the coil spring required to press the pump case against the fuel tank bottom, and an adequate amount of movement of the pump case relative to the metal column support while being urged by the coil spring, an interval between a tubular portion of the flange member, into which the metal column support is inserted, and the pump case needs to be kept at least at a predetermined length. To secure as long an interval as possible between the tubular portion of the flange member for receiving the metal column support and the pump case, it is preferable that a part of the tubular portion formed in the flange member that extends out toward the pump case be made smaller in length.

In light of the foregoing, a fuel supply apparatus is shown in FIG. 6 in which an insertion portion 102 in the form of a bottomed sleeve, composed of a tubular portion 103 and a bottom portion 104, is formed so as to extend from a plate-shaped flange body 101 of a flange member 100 toward the side opposite to a pump case (not shown), and a metal column support 110 is inserted into the insertion portion 102. A coil spring 111 loads the pump case with a force that tends to move the pump case in a direction away from the flange member 100.

Here, assume that a vehicle experiences a collision and a harsh impact force is applied to the fuel tank mounted therein. In this case, the flange member 100, being attached to the upper wall of the fuel tank, concurrently moves with the fuel tank. The pump case, being coupled to the flange member 100 by the metal column support 110 and being pressed against the bottom of the fuel tank by the urging force of the coil spring 111, is forced to move by inertia even after the movements of the fuel tank and the flange member 100 are stopped. Since one end of the metal column support 110 coupled to the pump case is moved concurrently with the pump case, its other end is forced to tilt obliquely with respect to the flange member 100. That is, the metal column support may not be at a 90 degree angle with the flange member 100. Consequently, a crack 120 may develop in a corner portion which the flange body 101 forms with the tubular portion 103, which results in fuel leaking from within the fuel tank through the crack 120.

SUMMARY OF THE INVENTION

In view of the foregoing, an object of the present invention is to provide a fuel supply apparatus which is designed so that, even if a column support receiving portion of a supporting member is broken, the breakage is prevented from reaching both surfaces of the supporting member.

In a fuel supply apparatus according to a first aspect of the present invention, a bottom portion of an outer sleeve, formed continuously with a bottom portion of an inner sleeve for receiving a column support, is located on a same plane as the bottom portion of the inner sleeve, or extends farther on an opposite side of a pump case than the bottom portion of the inner sleeve. By this construction, even if a harsh impact force is applied to the fuel supply apparatus and as a result cracking occurs in a corner portion which a tubular portion of the inner sleeve forms with the bottom portion thereof, the resultant crack is prevented from reaching the tubular or bottom portion of the outer sleeve. That is, both surfaces of a supporting member are free from cracking. Accordingly, even if a crack develops in a column support receiving portion of a supporting member in a state where the fuel supply apparatus is attached to the fuel tank, fuel within the fuel tank is prevented from leaking through the crack to the outside.

Further, since the inner sleeve extends farther on the opposite side of the pump case than a supporting body, the length of the part of the inner sleeve that protrudes toward the pump case decreases. In the foregoing description, the pump case may be coupled to the column support so as to be movable along a longitudinal direction of the column support. The coil spring may load the pump case with a force that tends to move it in a direction away from the supporting member. Accordingly, it is possible to ensure that the pump case remains pressed against the bottom of the fuel tank in a state where the fuel supply apparatus is attached to the fuel tank.

Additionally, the sub tank to which the fuel within the fuel tank is supplied may be used as a pump case for housing a fuel pump. By keeping the level of the fuel within the sub tank higher than the level of the fuel within the fuel tank, even if the fuel remaining in the fuel tank becomes lower in volume, the fuel pump will be able to reliably draw in and discharge the fuel within the sub tank.

Furthermore, the inner sleeve may have a rib formed at the outer periphery thereof. This helps improve the strength of the inner sleeve, and consequently the inner sleeve becomes resistant to breakage. When an impact force is applied to the fuel supply apparatus, breakage tends to occur particularly in the mechanically weak portion formed in the inner sleeve's tubular portion for receiving the column support. Consequently, in the foregoing construction, the inner sleeve may have a mechanically weak portion formed in the tubular portion, thereby the parts of the inner sleeve other than the tubular portion are protected from cracking. Furthermore, the supporting member may be made of resin and thus can be molded in one piece with ease.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

Figure 2:
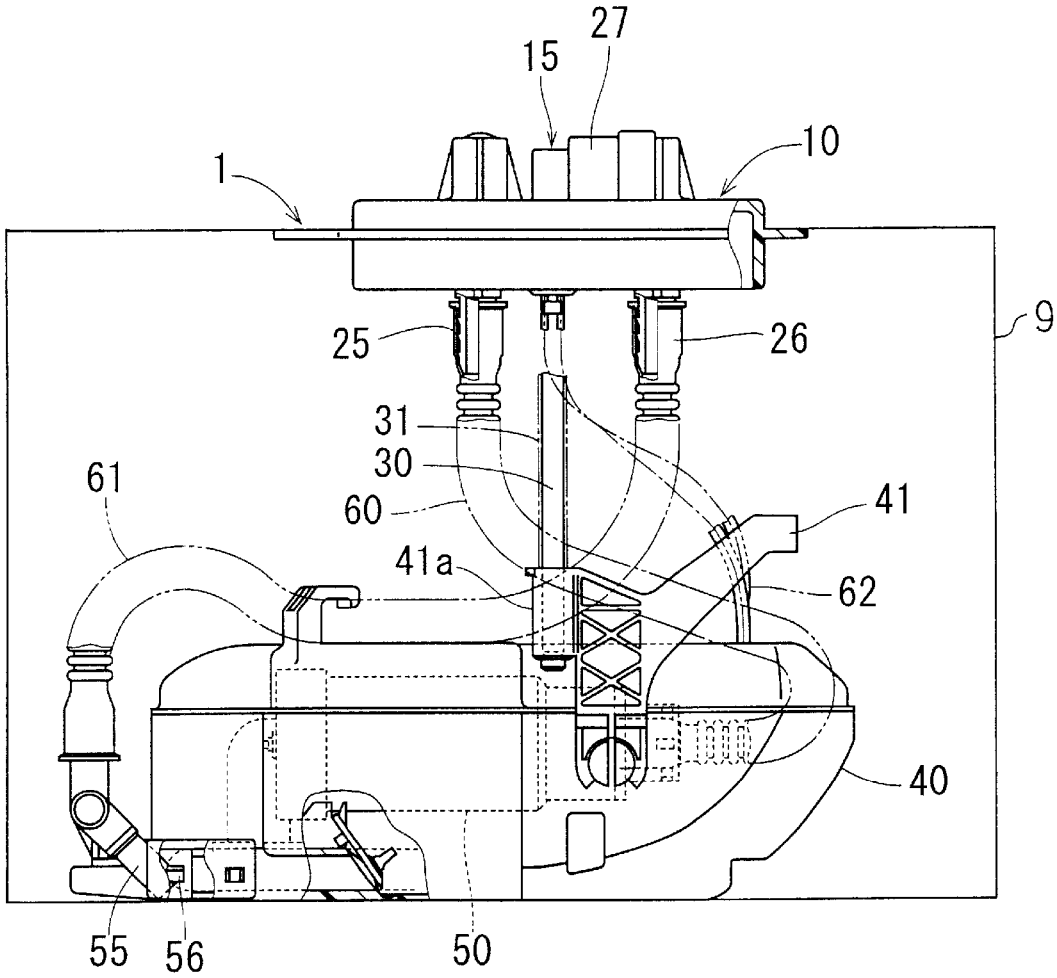
FIG. 2 is a front view showing the fuel supply apparatus in accordance with a first embodiment of the present invention.

FIG. 2 shows a fuel supply apparatus in accordance with a first embodiment of the present invention. The fuel supply apparatus 1 has a flange member 10 which is attached to an upper wall of a fuel tank 9 made of resin. The other components constituting the fuel supply apparatus 1 are accommodated in the fuel tank 9. The flange member 10, acting as a supporting member, and a sub tank 40, acting as a pump case, are each made of resin and coupled to a column support 30 made of metal. The column support 30 is inserted through a tubular portion 41*a* of a stay 41 supported by the sub tank 40. The sub tank 40 is movable along a longitudinal direction of the column support 30. A coil spring 31 loads the sub tank 40 with a force that tends to move it in a direction away from the flange member 10, that is, moves it toward a bottom of the fuel tank. In this way, a bottom portion of the sub tank 40 remains pressed against an inner bottom surface of the fuel tank in a state where the fuel supply apparatus 1 is attached to the fuel tank. With such a construction, even if the resin-made fuel tank expands or contracts due to a change in its internal pressure resulting from a temperature change, or a change in the amount of fuel, the bottom portion of the sub tank 40 is constantly kept pressed against the inner bottom surface of the fuel tank by an urging force exerted by the coil spring 31.

Figure 1A:
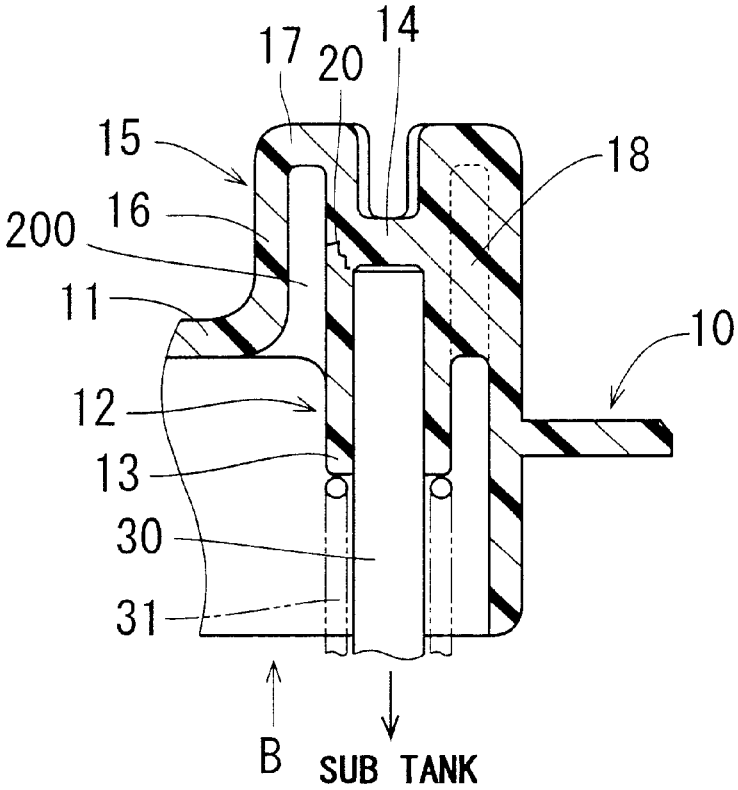
FIG. 1A is a cross-sectional view taken along line 1A—1A of FIG. 1B showing a flange member employed in a fuel supply apparatus in accordance with a first embodiment of the present invention.
Figure 1B:
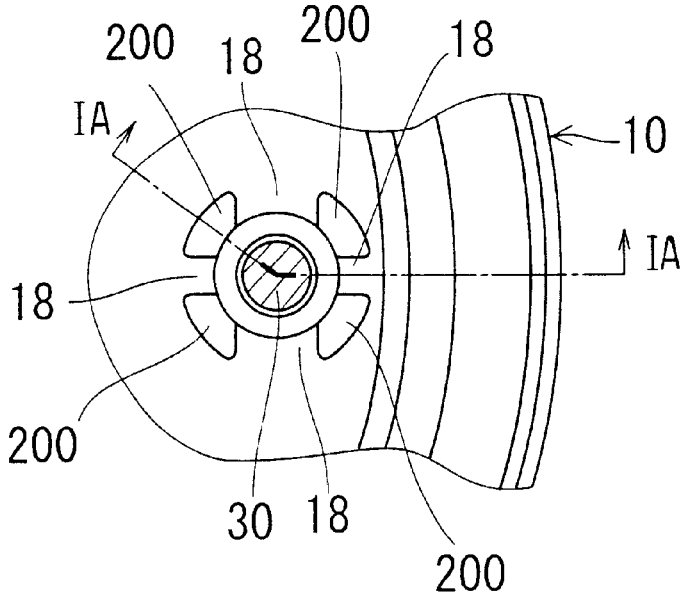
FIG. 1B is a view taken in a direction of arrow B shown in FIG. 1A in accordance with a first embodiment of the present invention.

As shown in FIG. 1A, the flange member 10 comprises: a flange body 11, provided as a supporting body, in the shape of a circular plate that is attached to the fuel tank; an inner sleeve 12 into which the column support 30 is inserted; and an outer sleeve 15 located at an outer periphery of the inner sleeve 12. These components are formed integrally with one another by using resin. The inner sleeve 12 in the form of a bottomed sleeve includes a tubular portion 13 and a bottom portion 14, and has on its sub-tank 40 side an opening. An inner bottom surface of the bottom portion 14 extends farther on the opposite side of the sub tank 40 than the flange body 11. The column support 30 has its one end press-inserted into the inner sleeve 12 beyond the flange body 11 to a point opposite the sub tank 40. The column support 30 may alternatively be inserted into the inner sleeve 12 by insert molding instead of by press insertion. The outer sleeve 15 includes a tubular portion 16 and a bottom portion 17. The bottom portion 17 extends farther on the opposite side of the sub tank 40 than the bottom portion 14 of the inner sleeve 12. In the outer sleeve 15, the tubular portion 16 is formed continuously with the flange body 11, and the bottom portion 17 is formed continuously with the bottom portion 14 of the inner sleeve 12. As shown in FIGS. 1A and 1B, at the outer periphery of the tubular portion 13 of the inner sleeve 12 are formed four pieces of ribs 18. The ribs 18 do not necessarily have to be four in number. The ribs 18 serve to improve the mechanical strength of the inner sleeve 12, so that the inner sleeve 12 resists breaking. Between the tubular portion 13 of the inner sleeve 12 and the tubular portion 16 of the outer sleeve 15 are formed spaces 200, which are arranged between the adjacent ribs 18 so as to surround the column support 30.

As shown in FIG. 2, the flange member 10 further comprises: a discharge pipe 25; a return pipe 26; and an electric connector 27 that are formed integrally with one another by using resin. Alternatively, the discharge pipe 25, the return pipe 26, and the electric connector 27 may be provided separately from one another when attached to the flange member 10. The discharge pipe 25 serves to discharge fuel discharged from a fuel pump 50 housed in the sub tank 40 to the outside of the fuel tank. The discharge pipe 25 and the fuel pump 50 are connected to each other by an accordion pipe 60. The fuel pump 50 is arranged horizontally within the sub tank 40. The return pipe 26 serves to return excessive fuel fed from the engine side into the fuel tank, and is connected to a jet pump 55 by an accordion pipe 61. The electric connector 27 serves to supply a driving current to the fuel pump 50 and to output signals detected in a level gage (not shown). The electric connector 27, an electric portion of the fuel pump 50, and the level gage are connected to one another by a lead wire 62.

The jet pump 55 emits, through a jet nozzle 56, fuel which has been returned through the accordion pipe 61 from the return pipe 26, draws in the fuel within the fuel tank by exploiting a suction pressure generated by a jet of the fuel that is lower than an atmospheric pressure, and forcibly feeds the fuel into the sub tank 40. Next, the fuel supply apparatus 1 will be described. When the engine is driven to operate and a driving current is supplied from the electric connector 27 to the fuel pump 50, the fuel pump 50 draws in the fuel within the sub tank 40 and then, after removing foreign substances, discharges the fuel through the discharge pipe 25 toward the engine.

The fuel having been returned from the engine side to the accordion pipe 61 through the return pipe 26 passes through the jet pump 55, and is thereafter emitted into the sub tank 40. At this time, the fuel within the fuel tank is drawn by a suction pressure resulting from a jet of the fuel. By the injection pressure of the jet pump 55, the level of the fuel within the sub tank 40 is raised with respect to the outside of the sub tank 40, and is maintained at a predetermined level. Consequently, even if no fuel exists around the jet pump 55 when the vehicle corners or is operated on a steep incline when the level of the fuel within the fuel tank is low, the fuel pump 50 is able to draw in the fuel within the sub tank 40 without causing improper fuel suctioning, that is, a disruption, thereby making it possible to continuously supply fuel to the engine.

When a considerable impact force is applied to the fuel supply apparatus 1 due to collision of the vehicle or other accident, and the sub tank 40 and the fuel pump 50 are moved relative to the flange member 10 and the fuel tank, the column support 30 is forced to tilt obliquely with respect to the flange member 10. Then, a tensile force is applied to a corner portion formed by the tubular portion 13 of the inner sleeve 12 and the bottom portion 14. This results in development of a crack 20. However, since the bottom portion 17 of the outer sleeve 15 is located farther on the opposite side of the sub tank 40 than the bottom portion 14 of the inner sleeve 12, the crack 20 developed in the inner sleeve 12 will reach the tubular portion 16 and the bottom portion 17 of the outer sleeve 15. Consequently, even if the inner sleeve 12 suffers from the crack 20, the fuel within the fuel tank will not leak to the outside of the fuel tank.

Second Embodiment

Figure 3:
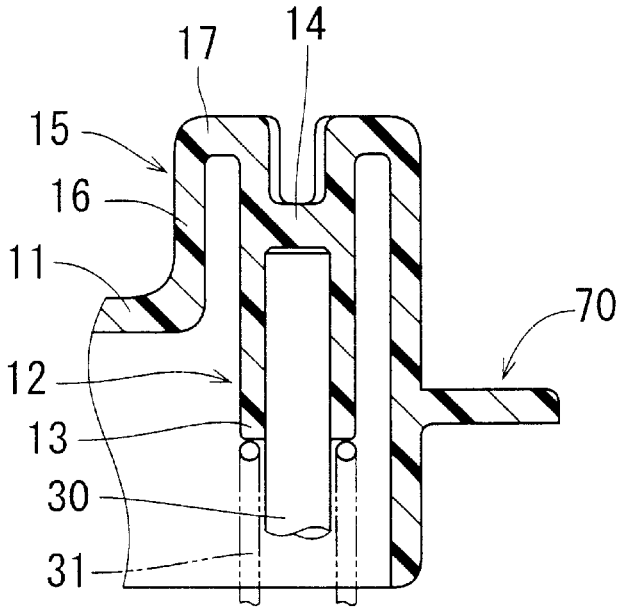
FIG. 3 is a cross-sectional view showing the flange member of the fuel supply apparatus in accordance with a second embodiment of the present invention.

FIG. 3 shows a second embodiment of the present invention. In a flange member 70, provided as a supporting member, according to the second embodiment, no rib is formed at the outer periphery of the inner sleeve 12.

Third Embodiment

Figure 4:
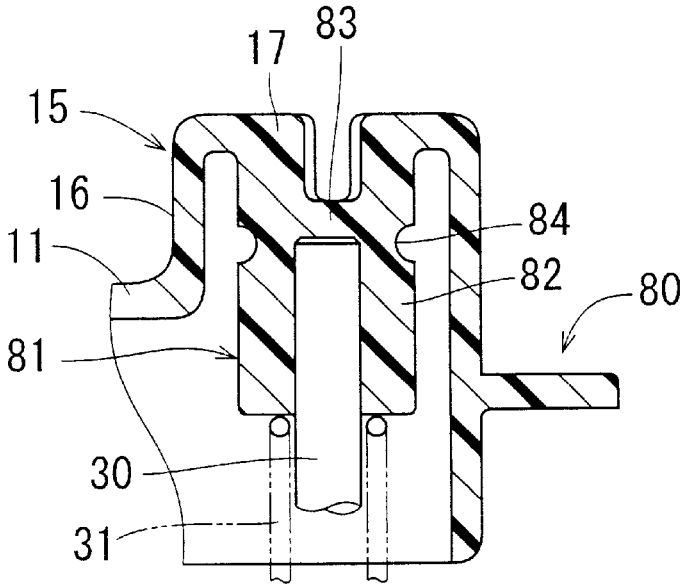
FIG. 4 is a cross-sectional view showing the flange member of the fuel supply apparatus in accordance with a third embodiment of the present invention.

FIG. 4 shows a third embodiment of the present invention. In a flange member 80 according to the third embodiment, an annular recess 84 is formed in an outer corner portion which a tubular portion 82 of an inner sleeve 81 forms with a bottom portion 83 thereof. When an impact force is applied to the fuel supply apparatus, cracking tends to occur particularly in the annular recess 84 because of its weak mechanical strength. Consequently, regions of the flange member 80, other than the annular recess 84, are less susceptible to cracking, and thus no crack is developed in the outer sleeve 15.

Fourth Embodiment

Figure 5:
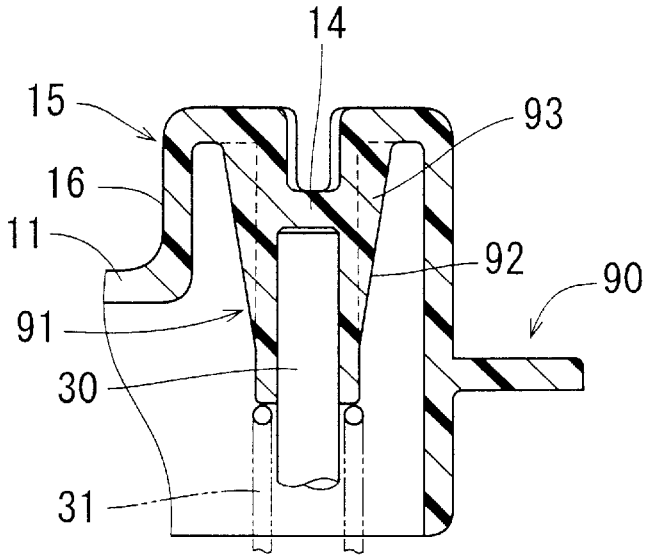
FIG. 5 is a cross-sectional view showing the flange member of the fuel supply apparatus in accordance with a fourth embodiment of the present invention.
Figure 6:
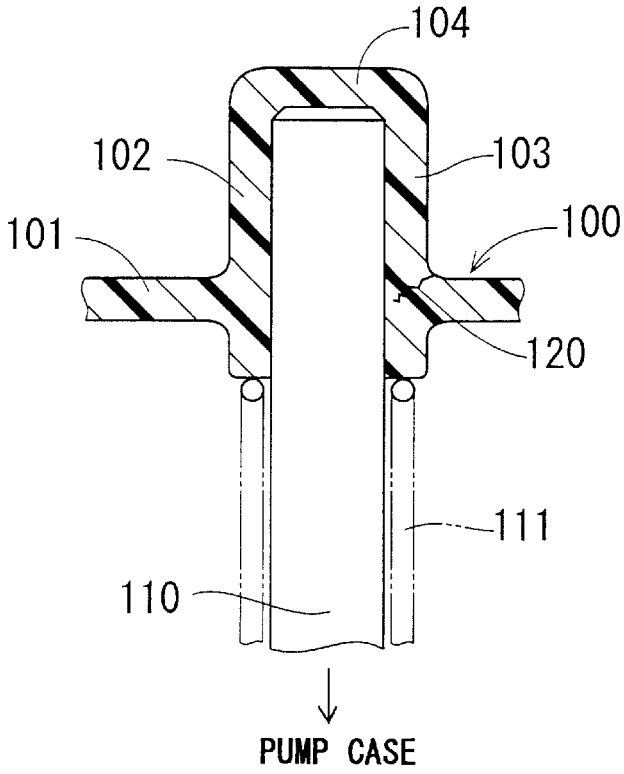
FIG. 6 RELATED ART
FIG. 6 is a cross-sectional view showing a flange member in a conventional example of a fuel supply apparatus.

FIG. 5 shows a fourth embodiment of the present invention. In this embodiment, an inner sleeve 91 has four pieces of ribs 93 formed at its outer periphery. The ribs 93 are each shaped so that its overhanging portion becomes gradually smaller from the interior of the bottom portion 17 of the outer sleeve 15 toward a front end of a tubular portion 92 of the inner sleeve 91. Providing these ribs helps improve the mechanical strength of the inner sleeve 91, and consequently the inner sleeve 91 becomes resistant to breakage.

In the plurality of embodiments described herein above, on the outside of the inner sleeve for receiving the column support 30 is additionally arranged the outer sleeve 15, so that the bottom portion 17 of the outer sleeve 15 extends farther on the opposite side of the sub tank 40 than the bottom portion of the inner sleeve. In this construction, even if an impact force is applied to the fuel supply apparatus and the column support 30 is inclined with respect to the inner sleeve, resulting in a crack in the inner sleeve, the crack never reaches the outer sleeve 15. Accordingly, even if, for example, a vehicle experiences a collision and the resultant shock causes breakage in the inner sleeve of the flange member, the fuel within the fuel tank is prevented from leaking to the outside of the fuel tank.

Moreover, a part of the inner sleeve 91 of the flange member 90 for receiving the column support 30 protrudes in the direction opposite to the sub tank. This arrangement helps reduce the length of the part of the inner sleeve that protrudes from the flange member toward the sub tank, and thereby increases the interval between the inner sleeve and the sub tank. Also in a case where the fuel supply apparatus is accommodated in a low-profile fuel tank, the interval between the inner sleeve and the sub tank can be kept at a predetermined length or above. This makes it possible to keep an appropriate urging force exerted by the coil spring, and to secure an adequate amount of movement of the sub tank 40 required to keep up with the deformation of the fuel tank.

Although, in the above-described embodiments, the bottom portion of the outer sleeve is located farther on the opposite side of the sub tank than the bottom portion of the inner sleeve, the bottom portion of the inner sleeve and the bottom portion of the outer sleeve may be located on the same plane. Moreover, the flange member may be made of metal or other material instead of resin. Further, where the fuel tank is made of metal instead of resin, the fuel tank is less likely to deform. Thus, in this case, in order to bring the sub tank into contact with the inner bottom surface of the fuel tank with the fuel supply apparatus attached to the fuel tank, the sub tank should preferably be securely fixed to the other end of the column support. This eliminates the need to provide the coil spring for loading the sub tank with a force that tends to move it in a direction away from the flange member.

In any of the above-described embodiments, instead of the sub tank for storing fuel in such a way that its level is kept higher than the level of the fuel within the fuel tank, a pump case may be employed that serves merely to store a fuel pump.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel supply apparatus comprising:

a pump case housed in a fuel tank;

a fuel pump housed in the pump case, for drawing in and discharging fuel;

a supporting member attached to an upper wall of the fuel tank; and a column support for providing a connection between the supporting member and the pump case, wherein the supporting member comprises:

a plate-shaped flange body defining an inner sleeve;

a bottom portion formed in the inner sleeve, the inner sleeve having on its pump-case side an opening and having an inner bottom surface which is located farther from the pump case than a portion of the supporting body, one end of the column support being inserted in the inner sleeve beyond the supporting body to the inner bottom surface; and an outer sleeve with a bottom formed in it, the outer sleeve having a bottom portion which is formed continuously with the bottom portion of the inner sleeve and having a tubular portion which is formed continuously with the supporting member, the bottom portion of the outer sleeve being located in a plane farther from the pump case than the bottom portion of the inner sleeve.

2. The fuel supply apparatus according to claim 1, further comprising:

a coil spring disposed around the column support, for supplying the pump case with a force that tends to move the pump case in a direction away from the supporting member, wherein the pump case is coupled to the column support so as to be movable along a longitudinal direction of the column support.

3. The fuel supply apparatus according to claim 1, wherein the pump case is a sub tank, and the fuel pump draws and discharges fuel which is fed from the fuel tank to the sub tank.

4. The fuel supply apparatus according to claim 2, wherein the pump case is a sub tank, and the fuel pump draws and discharges fuel which is fed from the fuel tank to the sub tank.

5. The fuel supply apparatus according to claim 1, wherein the inner sleeve has a rib formed at an outer periphery thereof.

6. The fuel supply apparatus according to claim 2, wherein the inner sleeve has a rib formed at an outer periphery thereof.

7. The fuel supply apparatus according to claim 3, wherein the inner sleeve has a rib formed at an outer periphery thereof.

8. The fuel supply apparatus according to claim 4 wherein the inner sleeve has a rib formed at an outer periphery thereof.

9. The fuel supply apparatus according to claim 1, wherein the inner sleeve has a mechanically weak portion formed in a tubular portion thereof into which the column support is inserted.

10. The fuel supply apparatus according to claim 2, wherein the inner sleeve has a mechanically weak portion formed in a tubular portion thereof into which the column support is inserted.

11. The fuel supply apparatus according to claim 3, wherein the inner sleeve has a mechanically weak portion formed in a tubular portion thereof into which the column support is inserted.

12. The fuel supply apparatus according to claim 4, wherein the inner sleeve has a mechanically weak portion formed in a tubular portion thereof into which the column support is inserted.

13. The fuel supply apparatus according to claim 5, wherein the inner sleeve has a mechanically weak portion formed in a tubular portion thereof into which the column support is inserted.

14. The fuel supply apparatus according to claim 6, wherein the inner sleeve has a mechanically weak portion formed in a tubular portion thereof into which the column support is inserted.

15. The fuel supply apparatus according to claim 7, wherein the inner sleeve has a mechanically weak portion formed in a tubular portion thereof into which the column support is inserted.

16. The fuel supply apparatus according to claim 1, wherein the supporting member is made of resin, and the column support is made of metal.

17. A fuel supply apparatus comprising:

a pump case housed in a fuel tank;

a fuel pump housed in the pump case, for drawing in and discharging fuel;

a flange body defining an outer sleeve and an inner sleeve, wherein the flange body is attached to an upper wall of the fuel tank; and a bottom portion formed in the outer sleeve and a bottom portion formed in the inner sleeve, wherein the bottom portion of the outer sleeve and the bottom portion of the inner sleeve are parallel to each other and continuously formed with the flange body and each bottom portion closes an end portion of each respective sleeve at a location farthest from the pump case.

18. The fuel supply apparatus of claim 17, further comprising:

a plurality of ribs located about an outer periphery of the inner sleeve, wherein the sleeves taper from a thickest portion adjacent a bottom portion of the outer sleeve to a point along the inner sleeve.

19. The fuel supply apparatus of claim 17, further comprising:

a coil spring abutting the inner sleeve and coaxial with the inner sleeve; and a column support passing through the coil spring and into the inner sleeve and abutting against an inner sleeve bottom surface, wherein the pump case is coupled to the column support so as to be movable along a longitudinal direction of the column support.

20. The fuel supply apparatus of claim 17, wherein the inner sleeve defines an annular recess to provide a mechanically weak point in the inner sleeve.

* * * * *